US010233730B2

(12) United States Patent
Gao et al.

(10) Patent No.: US 10,233,730 B2
(45) Date of Patent: Mar. 19, 2019

(54) CENTRIFUGAL PARTICLE ACCUMULATOR AND FILTER

(71) Applicant: HALLIBURTON ENERGY SERVICES, INC., Houston, TX (US)

(72) Inventors: Bo Gao, Spring, TX (US); Nicholas Budler, Claremore, OK (US); Linda Xin, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/114,696

(22) Filed: Aug. 28, 2018

(65) Prior Publication Data

US 2018/0363426 A1 Dec. 20, 2018

Related U.S. Application Data

(62) Division of application No. 15/107,943, filed as application No. PCT/US2015/042191 on Jul. 27, 2015, now Pat. No. 10,125,579.

(51) Int. Cl.
*E21B 43/02* (2006.01)
*E21B 27/00* (2006.01)
(Continued)

(52) U.S. Cl.
CPC ..... *E21B 43/02* (2013.01); *E21B 27/005* (2013.01); *E21B 34/06* (2013.01); *E21B 33/14* (2013.01)

(58) Field of Classification Search
CPC ..... E21B 43/02; E21B 34/06; E21B 33/14; E21B 27/005; E21B 33/13; E21B 10/60; E21B 7/18; E21B 21/06; E21B 29/00; E21B 31/08; E21B 43/10; B26D 7/08; B23D 61/02
See application file for complete search history.

(56) References Cited

U.S. PATENT DOCUMENTS 4,495,073 A 1/1985 Beimgraben
7,188,688 B1 3/2007 Lejeune
(Continued)

FOREIGN PATENT DOCUMENTS

CN 104514503 4/2015
EP 1413709 7/2010
(Continued)

OTHER PUBLICATIONS

U.S. Appl. No. 15/107,943, "Final Office Action", dated Dec. 19, 2017, 9 pages.
(Continued)

*Primary Examiner* — Yong-Suk Ro
(74) *Attorney, Agent, or Firm* — Kilpatrick Townsend & Stockton LLP

(57) ABSTRACT

An assembly may include a diverter extending inwardly from a casing string and extending along a length of the casing string. The assembly may also include a cavity defined by the diverter and the casing string. The cavity may be for receiving debris particles accumulated by a centrifuge positioned proximate to the diverter. The assembly may also include a valve extending between an inner surface of the casing string and an outer surface of the casing string, the valve may be in fluid communication with the cavity.

6 Claims, 9 Drawing Sheets

(51) Int. Cl.
*E21B 34/06* (2006.01)
*E21B 33/14* (2006.01)

(56) References Cited

U.S. PATENT DOCUMENTS

| | | | | |
|---|---|---|---|---|
| 7,487,831 | B2 | 2/2009 | Pluchek et al. | |
| 7,757,762 | B2 | 7/2010 | O'Malley | |
| 7,857,577 | B2 | 12/2010 | Eslinger | |
| 7,938,203 | B1 | 5/2011 | Hall et al. | |
| 8,454,829 | B2 | 6/2013 | Yaeger | |
| 8,651,181 | B2 | 2/2014 | Knobloch et al. | |
| 9,340,443 | B2 | 5/2016 | Bellman et al. | |
| 2004/0084177 | A1 | 5/2004 | Wang et al. | |
| 2004/0213661 | A1 | 10/2004 | Sekularac | |
| 2006/0065443 | A1 | 3/2006 | Hall et al. | |
| 2006/0213667 | A1 | 9/2006 | Mashburn et al. | |
| 2007/0228216 | A1 | 10/2007 | Westrom | |
| 2009/0001027 | A1 | 1/2009 | Carew | |
| 2010/0070376 | A1 | 3/2010 | Proud et al. | |
| 2010/0236833 | A1 | 9/2010 | Hall et al. | |
| 2010/0288492 | A1* | 11/2010 | Blackman | E21B 27/005 166/250.01 |
| 2012/0273278 | A1 | 11/2012 | Zhu | |
| 2013/0168091 | A1 | 7/2013 | Xu et al. | |
| 2014/0000428 | A1 | 1/2014 | Cairns et al. | |
| 2016/0076305 | A1* | 3/2016 | Blange | E21B 41/0085 175/24 |
| 2017/0157897 | A1 | 6/2017 | Kimura et al. | |
| 2017/0211358 | A1 | 7/2017 | Gao et al. | |

FOREIGN PATENT DOCUMENTS

| | | |
|---|---|---|
| WO | 0151766 | 7/2001 |
| WO | 2012036854 | 3/2012 |
| WO | 2014168481 | 10/2014 |
| WO | 2017003445 | 1/2017 |
| WO | 2017010989 | 1/2017 |

OTHER PUBLICATIONS

U.S. Appl. No. 15/107,943, "Non-Final Office Action", dated Aug. 10, 2017, 21 pages.
U.S. Appl. No. 15/107,943, "Non-Final Office Action", dated Mar. 21, 2018, 8 pages.
U.S. Appl. No. 15/107,943, "Notice of Allowance", dated Jun. 13, 2018, 8 pages.
U.S. Appl. No. 15/107,943, "Restriction Requirement", Jul. 12, 2017, 6 pages.
FR1656027 , "Office Action", dated May 29, 2018, 10 pages.
FR1656027 , "Office Action", dated Dec. 12, 2016, 2 pages.
PCT/US2015/042191 , "International Search Report and Written Opinion", dated Apr. 18, 2016, 10 pages.
Weatherford , "MudMaster II Filter Shoe and Auto-Fill Float Equipment", retrieved from the internet at http://www.weatherford.com/doc/wft022658, at least as early as May 5, 2015, 4 pages.
U.S. Appl. No. 16/114,787, Non Final Office Action, dated Sep. 20, 2018, 8 pages.

* cited by examiner

CENTRIFUGAL PARTICLE ACCUMULATOR AND FILTER

CROSS-REFERENCE TO RELATED APPLICATIONS

This is a divisional of U.S. patent application Ser. No. 15/107,943 filed Jun. 24, 2016 (allowed), which is a national phase entry under 35 USC § 371 of International Patent Application No. PCT/US2015/042191 filed Jul. 27, 2015, the entireties of which are incorporated herein by reference.

TECHNICAL FIELD

The present disclosure relates generally to wellbore drilling and completion. More specifically, but not by way of limitation, this disclosure relates to assemblies for use in controlling the entry of debris and particulate materials into a casing string.

BACKGROUND

During completion of the wellbore the annular space between the wellbore wall and a casing string (or casing) can be filled with cement. This process can be referred to as "cementing" the wellbore. The casing string can include floating equipment, for example a float collar and a guide shoe. Fluid, such as drilling fluid or mud, can be present within the wellbore. The fluid can include debris particles. The fluid, including the debris particles, can enter the casing string and can come in contact with the floating equipment. The debris particles can partially or fully clog the valves of the floating equipment and may contaminate the cement. The floating equipment can fail to properly function during the cementing of the wellbore when the valves are partially or fully clogged. The cement job can be weak or otherwise fail to properly function when the floating equipment fails to properly function, for example due to clogged valves or the resulting contaminated cement.

DETAILED DESCRIPTION

Certain aspects and features of the present disclosure are directed to a filter assembly that includes a particle accumulator and a filter element. The filter assembly can prevent debris particles (or particles) from entering floating equipment within a casing string. In some aspects, the particle accumulator and filter element can be used in sand filtering applications. The particle accumulator and filter element can be positioned within the casing string. In some aspects, the particle accumulator and filter element can be positioned within a casing shoe of the casing string. The particle accumulator and filter element can be coupled to the casing string at the well site, or in some aspects, one or both of the particle accumulator and filter element can be coupled to a substitute piece of threaded pipe ("sub"). The sub can be coupled to a casing tube of the casing string at the well site. The casing string can also include floating equipment, for example but not limited to a float collar or a guide shoe.

In some aspects, multiple filter assemblies can be positioned in a casing string in series. The use of multiple filter assemblies in series can improve the filtering of the fluid and can increase the amount of the time the filter assemblies function.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative examples but, like the illustrative examples, should not be used to limit the present disclosure.

Figure 1:
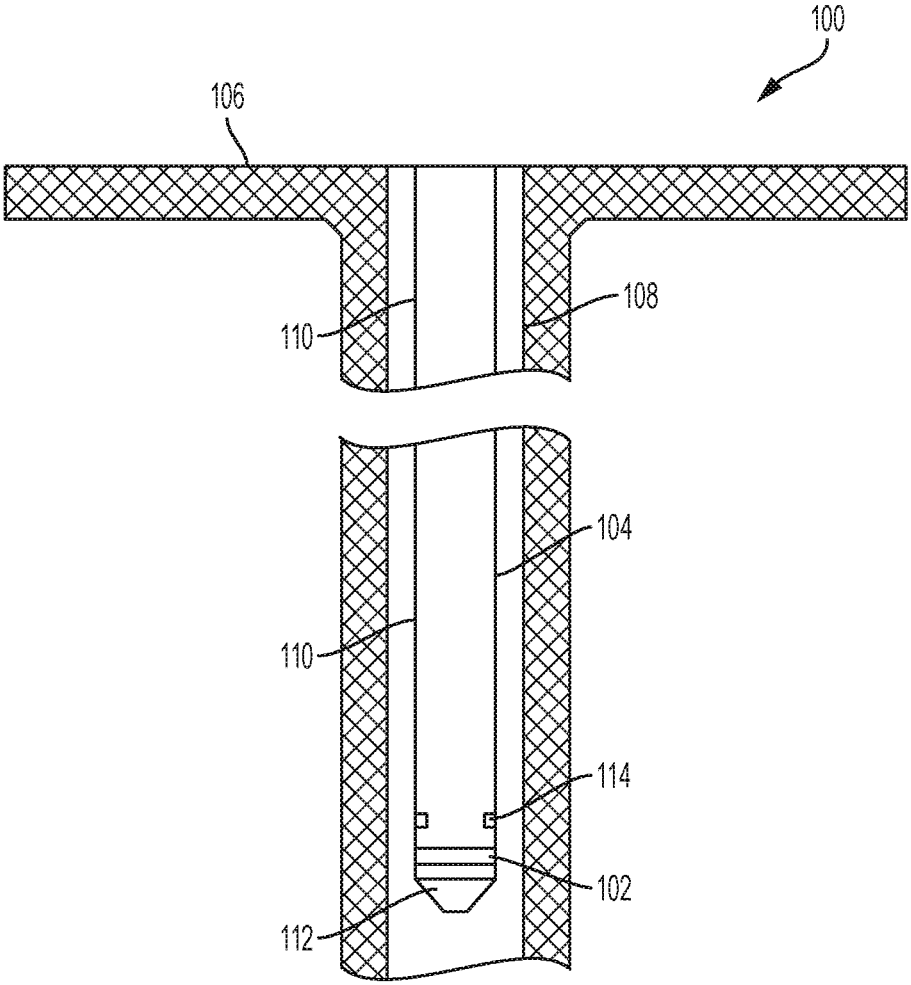
FIG. 1 is a schematic of a well system including a filter assembly positioned within a casing string, according to an aspect of the present disclosure.

FIG. 1 is a schematic of a well system 100 that includes a filter assembly 102 positioned within a tubing string, for example casing string 104. The filter assembly 102 can include a particle accumulator and a filter element. The casing string 104 can extend from a surface 106 of a wellbore 108 into a subterranean formation. The casing string 104 can be run into the wellbore 108 to protect or isolate formations adjacent to the wellbore 108. The casing string 104 can be comprised of multiple casing tubes 110 that can be coupled together at the surface 106 and positioned within the wellbore 108.

The casing string 104 can include a casing shoe 112. In some aspects, the casing shoe 112 can be a guide shoe or a float shoe. The casing shoe 112 can help guide the casing string 104 as it is positioned within the wellbore 108. The filter assembly 102 can be positioned within the casing string 104, for example above the casing shoe 112. In some aspects, the filter assembly 102 can be positioned elsewhere in the casing string 104, for example but not limited to in the casing shoe 112.

The casing string 104 can include floating equipment 114, for example but not limited to a float collar or a guide shoe. The floating equipment 114 can be used during cementing of the wellbore 108. The floating equipment 114 can include valves that can become fully or partially clogged by debris particles that enters the casing string 104. The floating equipment 114 can fail to properly function when the valves are fully or partially clogged. The cementing of the wellbore 108 can be weak or otherwise fail to properly function when the floating equipment 114 fails to properly function or the cement is contaminated with debris.

The filter assembly 102 can filter debris particles from fluid that enters the casing string 104. The filter assembly 102 can prevent the particles from entering the casing string 104 and partially or fully clogging the valves of the floating equipment 114. In some aspects, the filter assembly 102 can also prevent the debris particles from passing through the casing shoe 112 and clogging a valve of the casing shoe 112. In some aspects, the filter assembly 102 can be used to filter sand or other particles from production fluid.

Figure 2A:
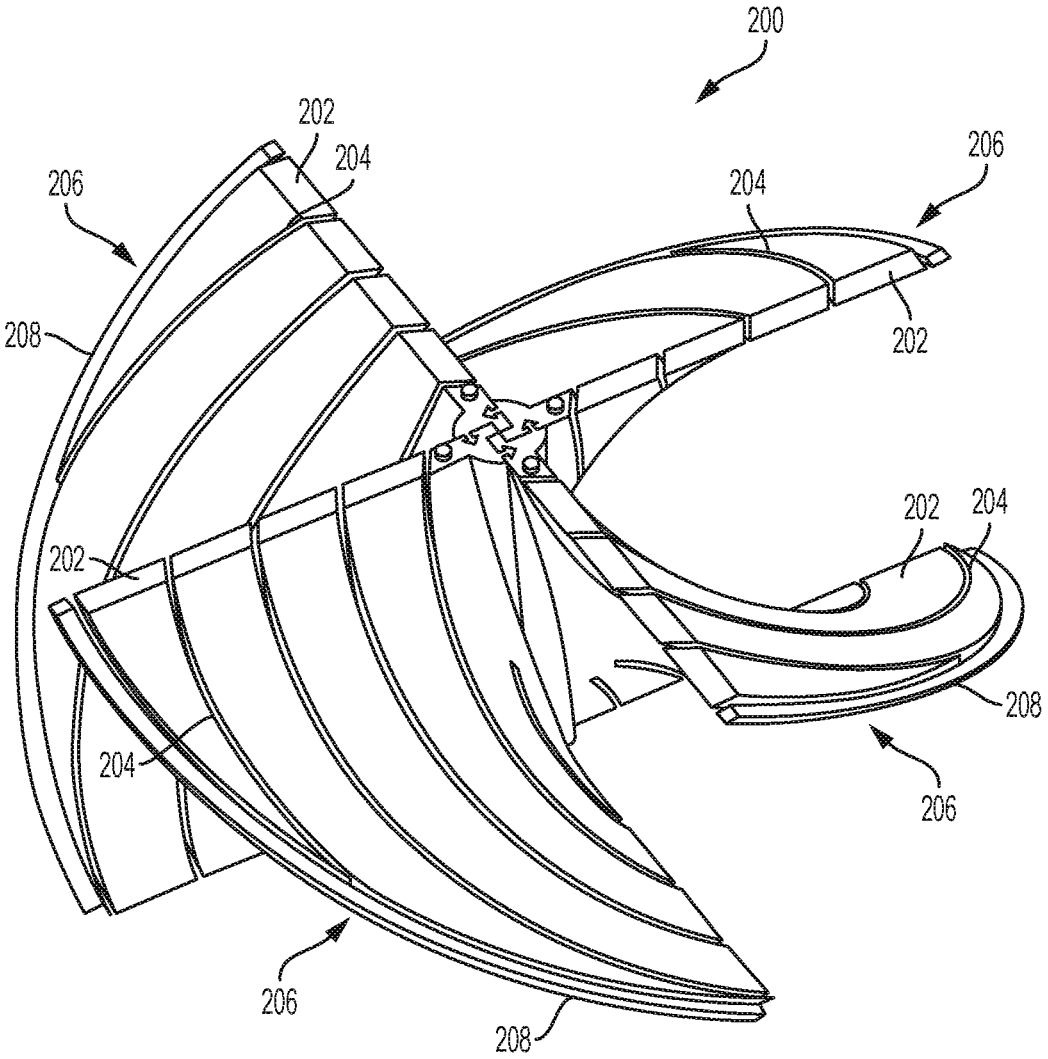
FIG. 2A is a perspective view of an example of a centrifuge for use in the filter assembly of FIG. 1, according to an aspect of the present disclosure.
Figure 4:
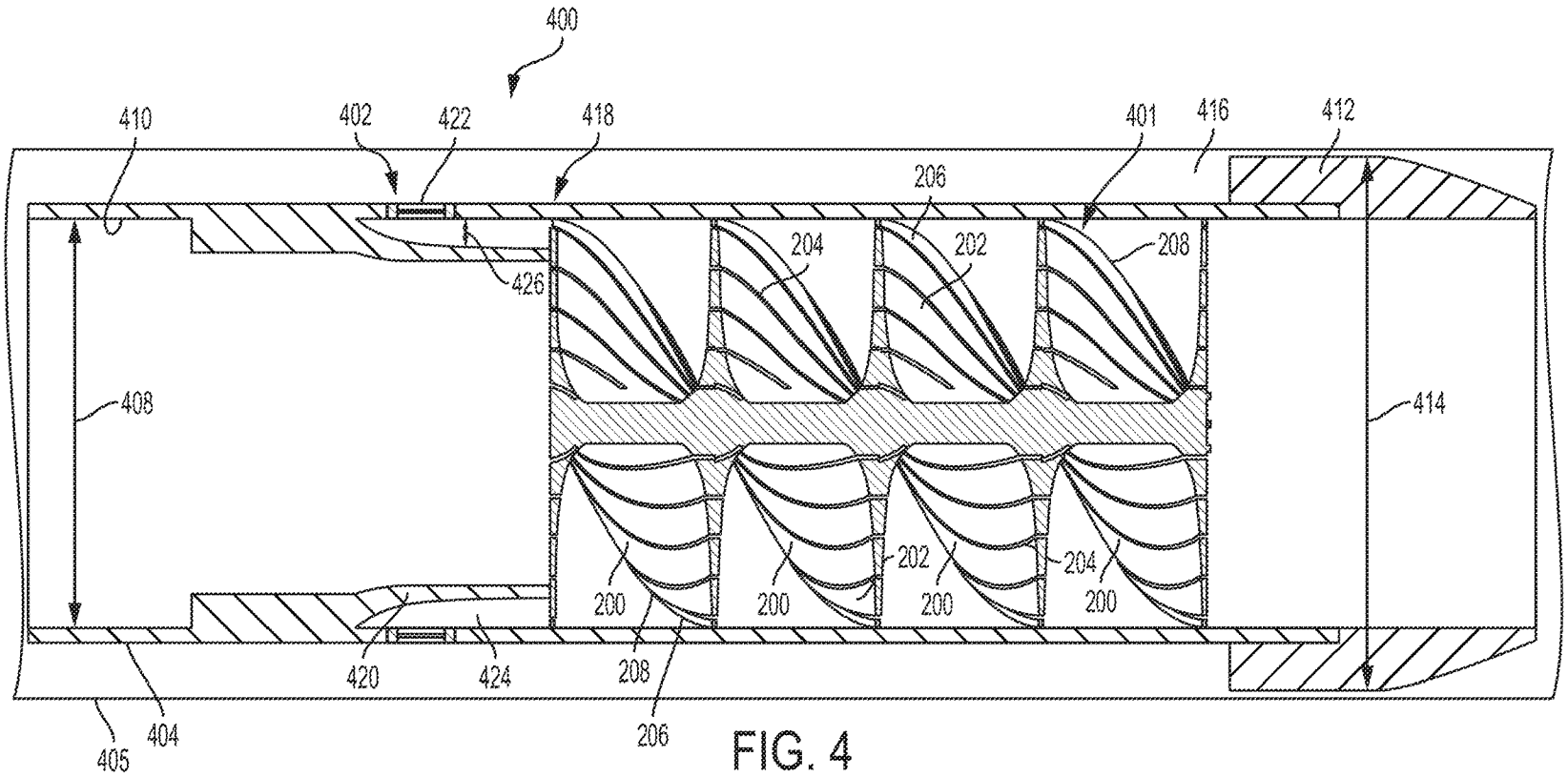
FIG. 4 is a cross-sectional side view of a filter assembly that includes a particle accumulator and a filter element, according to an aspect of the present disclosure.
Figure 5:
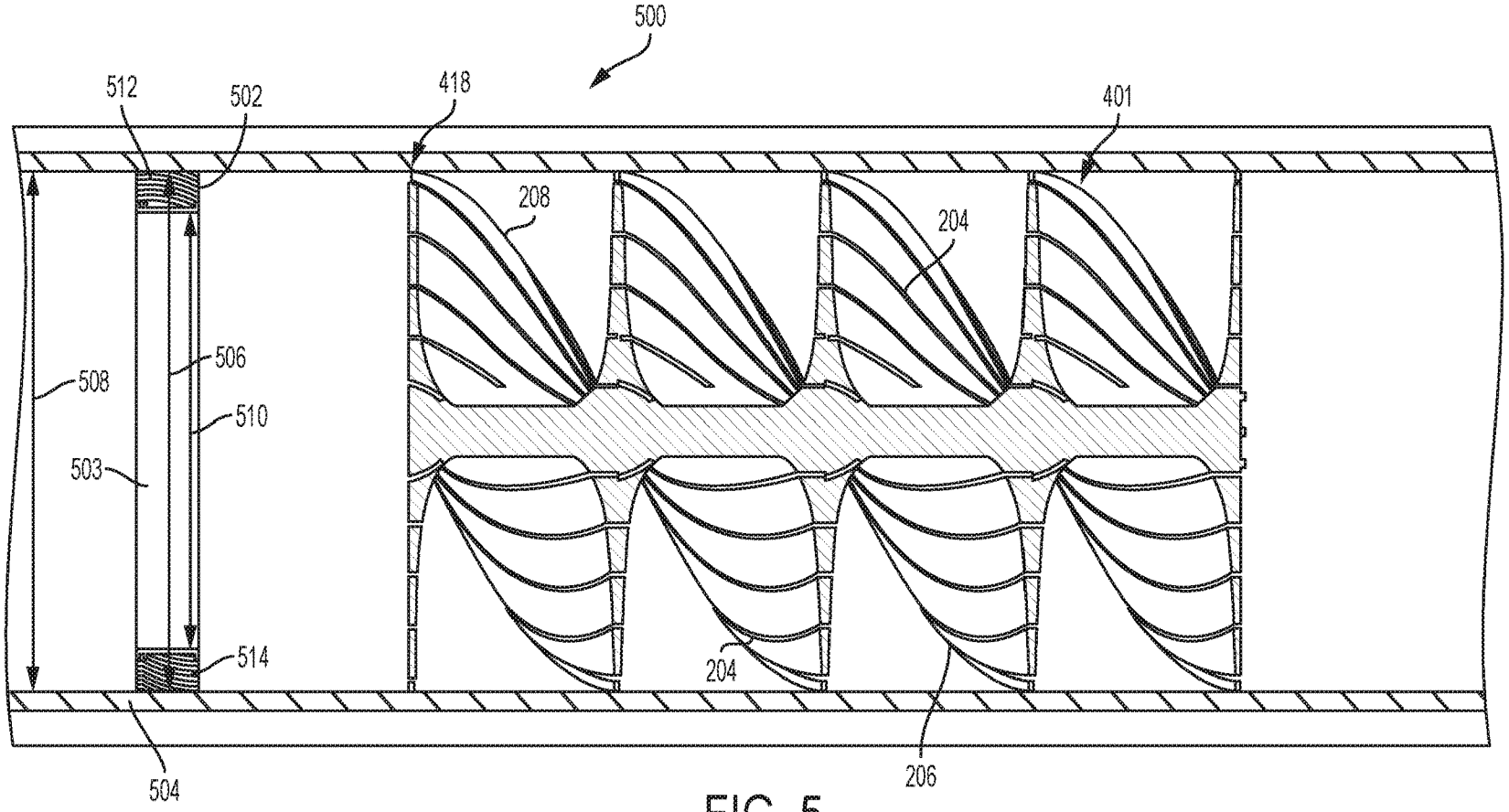
FIG. 5 is a cross-sectional side view of another filter assembly that includes a particle accumulator and a filter element, according to another aspect of the present disclosure.

FIG. 2A shows a centrifuge 200, one or more centrifuges 200 can form a particle accumulator of the filter assembly 102. The particle accumulator can be in a range of approximately 1 foot to approximately 6 feet and can be comprised of one or more centrifuges. The filter assembly 102 can also include a filter element that can prevent the particles accumulated by the centrifuge 200 from traveling past the filter element. FIGS. 4-6 show two examples of filter elements that can be used in conjunction with the centrifuge 200, though other suitable filter elements may be used. The centrifuge 200 can have a maximum width that can be approximately equal to an inner diameter of the casing string 104. In some aspects, the centrifuge 200 can be assembled from multiple parts. For example, the centrifuge 200 can be assembled from multiple blades 202. In some aspects, the centrifuge 200 can be manufactured as a single piece. The blades 202 can be divided into pieces by slots 204. The slots 204 can be eccentric slots (e.g., non-intersecting arced slots). The pieces of the blades 202 can be coupled together by any suitable attachment mechanism. For example, a bar may extend within the blade 202, which each portion of the blade 202 is coupled to. In some aspects, a bar may extend along a surface of the blade 202 that is not in contact with the fluid, and the pieces that make up the blade 202 may be coupled to the bar via fasteners, for example screws. In some aspects, the slots 204 may transition from slots (e.g., openings) to grooves (e.g., a recess that does not completely divide the blade 202 into separate pieces) along the length of the slot 204, such that the slots 204 do not divide the blade 202 into separate pieces.

The slots 204 can have a width. The width of the slots 204 can be in a range of approximately 0.1 mm to approximately 0.5 mm, though in some aspects other suitable widths may be used. The width of the slots 204 can be determined based on characteristics of the well the centrifuge 200 will be used in, for example but not limited to the size range of the debris particles found in the well. The slots 204 can all have the same width, or in some aspects, the width of the slots 204 may vary. The blades 202 can have an outer edge 206 that includes a groove 208. Some of the slots 204 of each blade 202 can intersect with the groove 208 of the blade 202.

The slots 204 may capture debris particles suspended in a fluid passing through the centrifuge 200 that have a width that is larger than the width of the slots 204. The particles stopped by the slots 204 can be forced along the length of the slots 204 by the fluid passing over the surface of the blades 202 along the length of the slots 204. The particles can be forced along the slots 204 until the slots 204 terminate at the groove 208 where the particles are deposited. The particles captured by the slots 204 can collect in the grooves 208 in the outer edges 206 of the blades 202. The longer the length of the slots 204 (e.g., the longer the length of the centrifuge) the more efficient the accumulation of the particles in the grooves 208 can be. The centrifuge can be comprised of a drillable material, for example but not limited to a composite, phenolic, aluminum or other suitable drillable material.

Figure 2B:
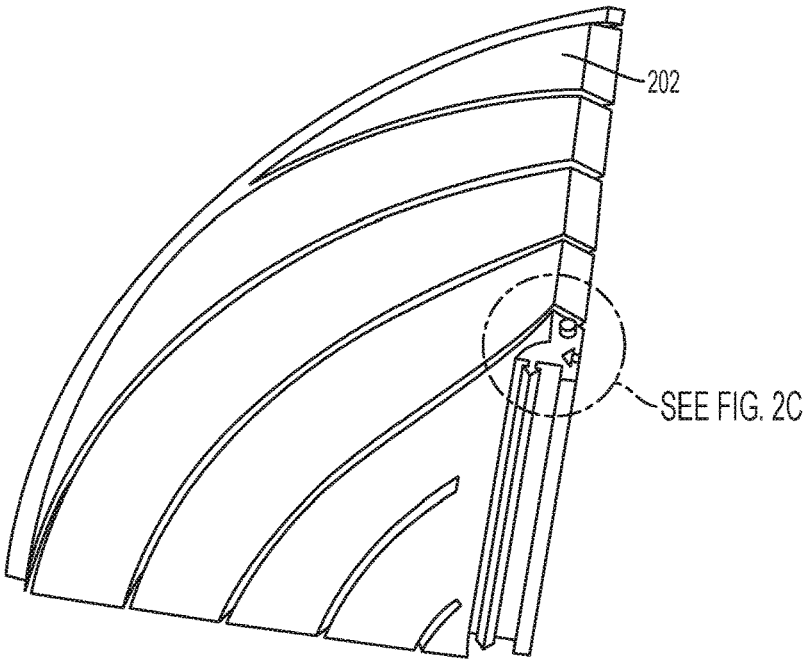
FIG. 2B is a perspective view of a blade of the centrifuge of FIG. 2, according to an aspect of the present disclosure.
Figure 2C:
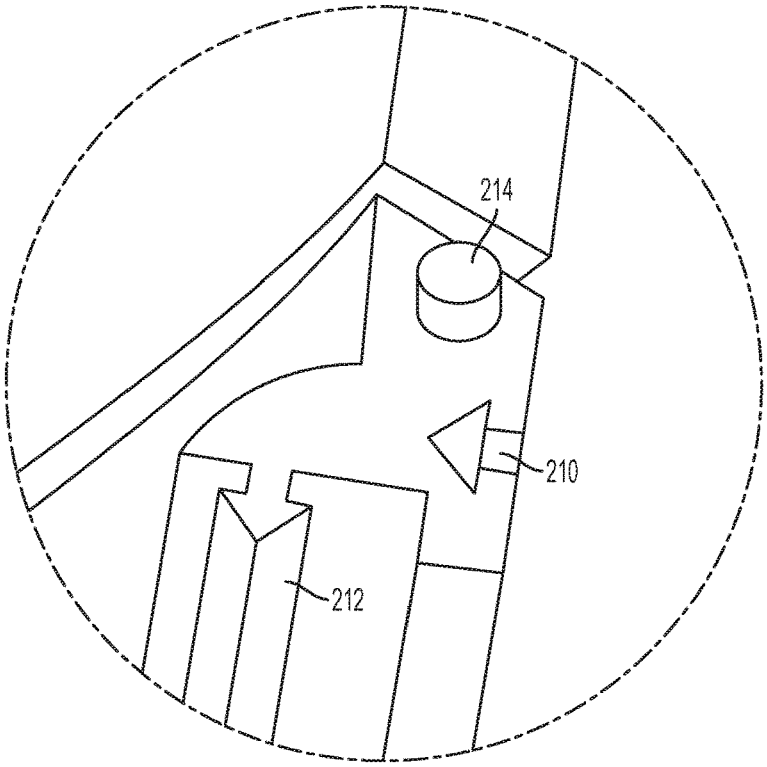
FIG. 2C is an enlarged perspective view of a portion of the blade of FIG. 2B, according to an aspect of the present disclosure.

FIG. 2B depicts a blades 202 of the centrifuge 200. The blade 202 can be coupled to additional blades 202 to form the centrifuge 200. The blades 202 can be coupled together around a central axis via mating elements. FIG. 2C shows an enlarged view of the mating elements. The mating elements can be a concave portion 210 and a convex portion 212. The concave portion 210 can be generally vertical. The convex portion 212 can be generally vertical, so as to mate with the concave portion 210. As shown in FIG. 2B-2C the concave portion 210 can be generally shaped like an arrow and the corresponding convex portion 212 can have a corresponding generally arrow-like shape. In some aspects, the mating elements may be other suitable shapes, for example rectangular or triangular. The convex portion 212 of one blade 202 can fit within the concave portion 210 of another blade 202. Multiple blades 202 may be coupled together via such mating elements.

The blade 202 may include a raised element or protrusion, for example column 214, on a first surface of the blade 202. The blade 202 may also include a corresponding recess (not shown) for receiving the raised element on a second surface of the blade 202. In some aspects, the first surface can be the top surface of the blade 202 and the second surface can be the bottom surface of the blade 202. The column 214 can be generally circular in shape, though other suitable shapes may be used. The recess can be shaped to receive or mate with the column 214. The column 214 of one blade 202 can be positioned within the recess of another blade 202, thereby coupling the two blades 202 together in a linear direction (e.g., vertically or horizontally). In some aspects, other suitable mating elements may be used to vertically coupled two blades 202 together.

Figure 2D:
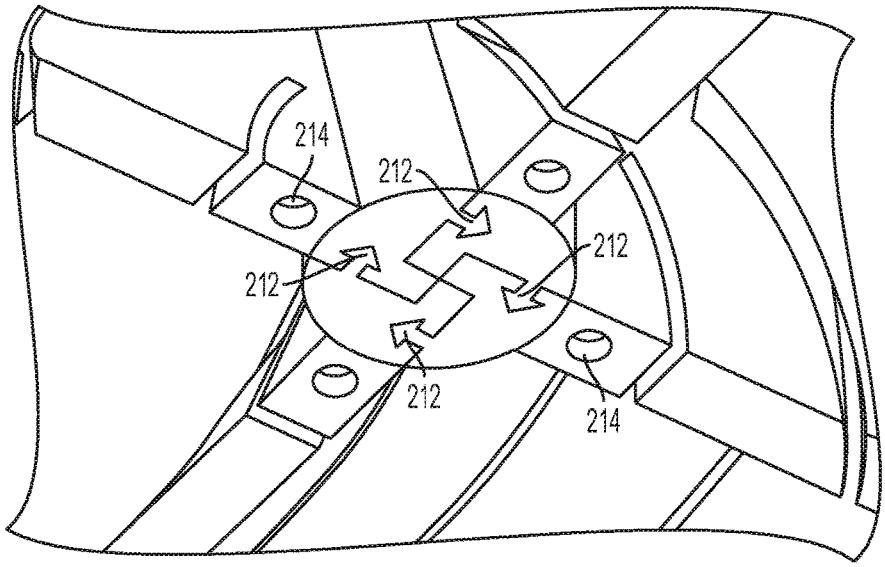
FIG. 2D is a perspective view of a portion of the centrifuge of FIG. 2A, according to an aspect of the present disclosure.

FIG. 2D depicts four blades 202 coupled together to form the centrifuge 200 of FIG. 2A via their respective mating elements, convex portions 212 and concave portions 210. In some aspects, the blades 202 can be coupled together via other suitable mating elements or may be coupled together in other suitable ways, for example but not limited to via fasteners, adhesives, or other suitable permanent or semi-permanent means. The length of the blades 202 can vary depending on the characteristics of the well the centrifuge 200 will be used in. While FIGS. 2A-2D depict four blades 202 being coupled together to form the centrifuge 200, in some aspects fewer or more blades may be used to form the centrifuge 200. As described with respect to FIG. 2C-2D an additional centrifuge can be vertically coupled to the centrifuge 200 by mating the column 214 on each blade 202 with the recess on each blade 202 of the additional centrifuge.

Figure 3:
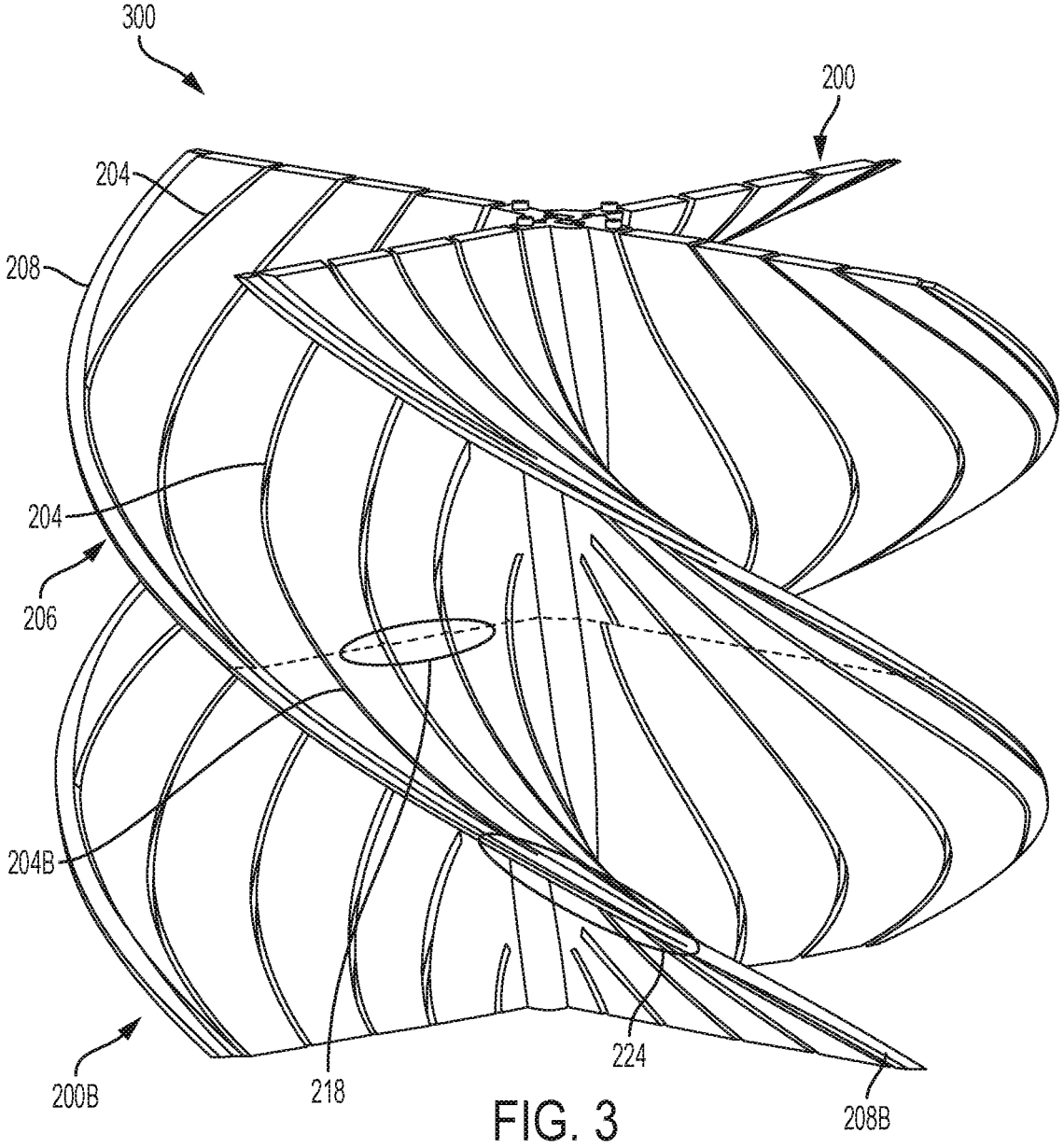
FIG. 3 is a perspective view of the centrifuge of FIG. 2A coupled together with another centrifuge, according to an aspect of the present invention.

FIG. 3 depicts an aspect of the invention in which a centrifuge, for example centrifuge 200, is coupled to second centrifuge, for example an additional centrifuge 200B. The centrifuge 200B can be identical to the centrifuge 200. The centrifuge 200 and centrifuge 200B can be coupled together to form a particle accumulator 300 for use in the filter assembly 102. Some of the slots 204 in the centrifuge 200 can terminate at the groove 208 at the outer edge 206 of the blades 202. Others of the slots 204 in the centrifuge 200 can terminate at a point that aligns with the start the slots 204B of the additional centrifuge 200B, as shown in the transition region 218. As shown, the slots 204 of the centrifuge 200 can align with the slots 204B of the additional centrifuge 200B. The slots 204, 204B can continue along a length of the blades 202, 202B until the slots 204, 204B ultimately terminate at a groove 208B, as shown, for example, in the termination region 224.

The particles stopped by the slots 204 of the centrifuge 200 can be forced along the length of the slots 204 until the slots 204 terminate in the one of the grooves 208 of the blades 202. The particles stopped by the slots 204 may also travel along the slots 204 until the slots 204 meet with the slots 204B of the additional centrifuge 200B. The particles may then travel along the length of the slots 204B until the slots 204B terminate into the grooves 208B at the outer edges 206B of the additional centrifuge 200B. Some particles may be stopped by the slots 204B and may travel along the length of the slots 204B until they reach the groove 208B.

While FIG. 3 shows two centrifuges 200, 200B coupled together, in some aspects additional centrifuges can be coupled together for use as a particle accumulator in the filter assembly 102. A longer particle accumulator can more efficiently accumulate debris particles in its grooves than a shorter particle accumulator.

FIG. 4 depicts a filter assembly 400 that includes a particle accumulator 401 and a discharge apparatus 402. The particle accumulator 401 can be comprised of four centrifuges 200 coupled together. The filter assembly 400 can be positioned within a casing string 404. The casing string 404 can be positioned within a wellbore 405. The casing string 404 can be sub. The sub can be threaded onto a casing tube at the well site. In some aspects, one or more parts of the filter assembly 400 can be positioned within the casing string 404 at the well site. The casing string 404 can be part of a casing shoe.

While the particle accumulator 401 includes four centrifuges 200 coupled together, in some aspects, more or fewer centrifuges 200 may be used. The width of the particle accumulator 401 can correspond to an inner diameter 408 of the casing string 404. The outer edge 206 of each of the centrifuges 200 can be spaced near an inner surface 410 of the casing string 404. In some aspects, the outer edge 206 may contact the inner surface 410 of the casing string.

A nose 412 can be coupled to an end of the casing string 404. The nose 412 can have a maximum outer diameter 414 that can be slightly less than an inner diameter of the wellbore 405. The nose 412 can force fluid into the casing string 404 instead of into an annulus 416 between the casing string 404 and the wellbore 405. The maximum outer diameter 414 of the nose 412 can be selected based on the particular well it will be used in. In some aspects, the maximum outer diameter 414 of the nose 412 can be approximately equal to an outer diameter of the casing string 404. In some aspects, the nose 412, the particle accumulator 401, and the discharge apparatus 402 can be coupled together within a sub. In some aspects, one or more of the nose 412, the particle accumulator 401, and the discharge apparatus 402 can be coupled together within the sub. In some aspects, one or more of the nose 412, the particle accumulator 401, and the discharge apparatus 402 can be coupled to the casing string 404 at the well site.

As fluid enters the casing string 404 some of the fluid can pass through the slots 204 of the particle accumulator 401. Some of the fluid can flow along the surface of the blades 202 of the particle accumulator 401. The fluid can include debris particles (and other particles). The slots 204 can act as a filter. The slots 204 can stop the particles having a width that is greater than the width of the slots 204. Some of the fluid flowing along the length of the slots 204 and the surface or the blades 202 can force the particles stopped at the slots 204 along the length of the slots 204. The slots 204 can act as rails and the particles can be forced along the length of the slots 204 by the fluid flowing along the surface of the blade 202. The particles can be forced along the length of the slots 204 until the respective slot terminates at the groove 208. The particles can collect in the groove 208 at the outer edge 206 of each of the blades 202. The particles can be forced along the length of the groove 208 by the flow of the fluid.

An end 418 of the particle accumulator 401 can be positioned proximate to the discharge apparatus 402. The discharge apparatus 402 can include a diverter 420 and a valve 422. The discharge apparatus 402 can be comprised of a drillable material, for example but not limited to a composite, phenolic, aluminum or other suitable drillable material. The diverter 420 can extend from the casing string 404 into the inside of the casing string 404. The diverter 420 can be in contact with or positioned close to the end 418 of the particle accumulator 401. The casing string 404, the diverter 420, and the particle accumulator 401 can together create a cavity 424. The cavity 424 can have a maximum width 426 that can be in the range of approximately 5% to approximately 15% of the inner diameter 408 of the casing string 404. The maximum width 426 of the cavity 424 can be selected based on various characteristics of the well, the casing string 404, the size of the valve 422, and the particle accumulator 401. For example, in some aspects a particle accumulator having multiple centrifuges (and thereby an increased length) can more efficiently collect debris particles closer to the inner surface 410 of the casing string 404 than a particle accumulator having few centrifuges. A longer particle accumulator may be used with a diverter that has a smaller maximum diameter as compared to a shorter particle accumulator.

The valve 422 can extend between the inner surface 410 off the casing string 404 and an outer surface of the casing string 404. The valve 422 can allow fluid communication between the cavity 424 and the annulus 416. The valve 422 can be a check valve that allows fluid and debris particles to flow from the cavity 424 into the annulus 416. The valve 422 can be a one-way valve that does not allow fluid and particles to flow from the annulus 416 into the cavity 424.

The groove 208 of the particle accumulator 401 can terminate at or near the cavity 316. The debris particles and fluid flowing along the length of the groove 208 can be forced into the cavity 424 by the fluid flow. The fluid and particles can collect in the cavity 424. The fluid and particles can be forced through the valve 422 into the annulus 416 when there is a sufficient back pressure (or pressure) within the cavity 424. The back pressure required to force the fluid and particles through the valve 422 into the annulus 416 can be based on the maximum width 426 of the cavity 424.

In some aspects, multiple filter assemblies 400 can be positioned within the casing string 404. The filter assemblies 400 can be positioned in series within the casing string 404. The inner diameter of the diverter of each filter assembly 400 can increase between the filter assemblies 400 positioned down hole relative to the other filter assemblies 400. The different inner diameters of each diverter can allow the various diverters to collect debris particles of different sizes and different percentages of the debris particulates present in the fluid flowing through casing string 404. Similarly, the particle accumulators positioned closer to the nose of the casing string 404 can have slots that have a larger width compared to the particle accumulators positioned up-hole. The filtering of debris particles from the fluid can be more efficient by positioning filter assemblies 400 in series. The number of filter assemblies 400 included in the casing string 404 can be determined based on characteristics of the well, the downhole conditions, the efficiency of the filtering process desired, and other factors.

FIG. 5 depicts a filter assembly 500 that includes the particle accumulator 401 and a filter element, for example slotted filter 502. The filter assembly 500 can be positioned within a casing string 504. In some aspects, the casing string 504 can be a sub that can be threaded onto a casing tube. In some aspects, the casing string 504 can be part of a casing shoe. The slotted filter 502 can be positioned up-hole relative to the particle accumulator 401. The slotted filter 502 can be comprised of drillable material, for example but not limited to a composite, phenolic, aluminum or other suitable drillable material.

As fluid enters the casing string 504 some of the fluid can pass through the slots 204 of the particle accumulator 401. As described above, for example with respect to FIGS. 2A-4, the slots 204 can stop the particles having a width that is greater than the width of the slots 204. The particles can be forced along the length of the slots 204 and into the groove 208 at the outer edge 206 of each of the blades 202. The particles can be forced along the length of the groove 208 by the flow of the fluid. The particles can exit the groove 208 at an end 418 of the particle accumulator 401.

The slotted filter 502 can be generally circular in shape and can define an opening 503. The slotted filter 502 can have an outer diameter 506 that can be approximately equal to an inner diameter 508 of the casing string 504. The slotted filter 502 can have a width 510 that can be in a range of approximate 5% to approximately 15% of the inner diameter 508 of the casing string 504. The slotted filter 502 can include multiple filter chambers defined by inclined blades 512, as described in more detail in FIG. 6A-6B. The inclined blades 512 can define filter slots 514. The filter slots 514 can have a width. The width of the filter slots 514 can be in a range of approximately 0.1 mm to approximately 0.5 mm, though smaller or larger sized filter slots 514 can be used. As the particles and particle laden fluid exit the groove 208 of the particle accumulator 401 they can enter the filter chambers of the slotted filter 502. The particles that have a width that is greater than the width of the filter slots 514 can be stopped by the filter slots 514. The fluid and smaller particles can flow through the slots of the slotted filter 502. The debris particles can collect in the corners of the filter chambers. The region of the filter slots 514 closer to the downhole side of the slotted filter 502 can remain free of particles. The fluid can continue to flow through the unclogged region of the filter slots 514. The slotted filter 502 can be flushed of the collected particles by forcing fluid into the casing string 504 from the surface of the wellbore or from a position uphole to the slotted filter 502. The debris particles collected in the slotted filter 502 can be forced out of the casing string 504 via the casing shoe. The useful life of the slotted filter 502 can be extended in this fashion.

In some aspects, multiple filter assemblies 500 can be positioned within the casing string 504. The width of the slots of the particle accumulator positioned furthest down hole can be smaller than the width of the slots of an additional particle accumulator positioned further up-hole. In some aspects, the width of the slots of the slotted filter of the filter assembly positioned further downhole may also be smaller than the width of the slots of the slotted filter of the more up-hole filter assembly. In other words, multiple filter assemblies can be positioned in series within the casing string 504. The slot size (e.g., the width of the slot) of the particle accumulator furthest downhole can be smaller than the slots of a particle accumulators positioned more uphole. Similarly, the width of the slots of the slotted filter of the filter assembly further downhole can be smaller than the slots of a slotted filter of a filter assembly positioned more uphole. The number of filter assemblies 500 positioned within the casing string 504 can be determined based on characteristics of the well, the downhole conditions, the efficiency of the filtering process desired, and other factors.

Figure 6A:
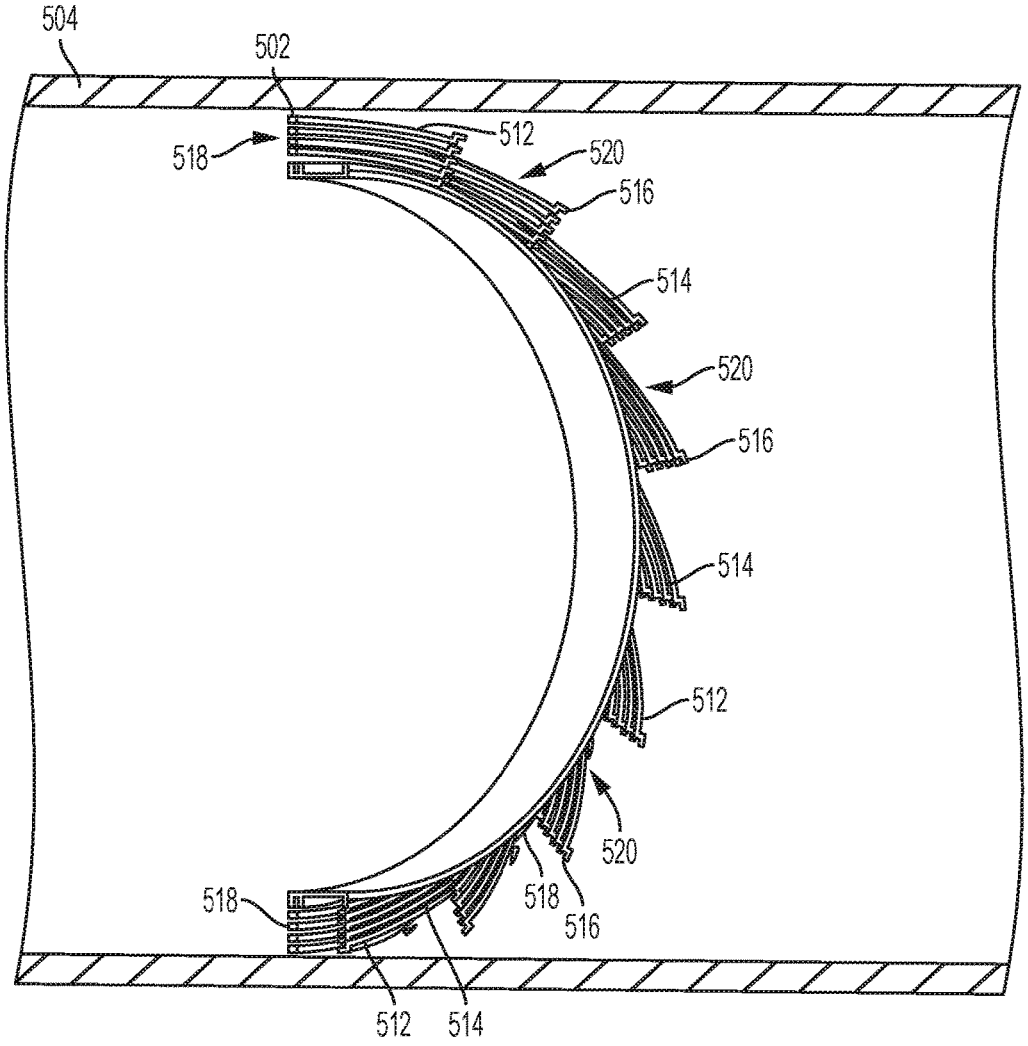
FIG. 6A is a cross-sectional side view of the filter element of FIG. 5.
Figure 6B:
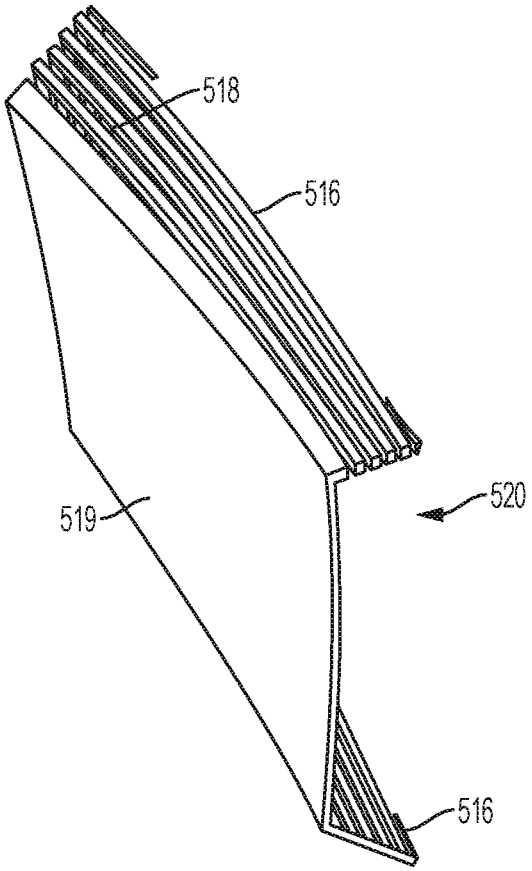
FIG. 6B is an enlarged perspective view of a portion of the filter element shown in FIGS. 5 and 6A.

FIG. 6A shows a cross-sectional perspective view of the slotted filter 502 and the casing string 504. The slotted filter 502 can include side walls 516 and a rear wall 518. The side walls 516 and rear wall 518 can include the inclined blades 512 that define the filter slots 514. The rear wall 518 can extend circumferentially around the slotted filter 502. As shown in FIG. 6B, which shows a single filter chamber 520, the side walls 516 and rear wall 518, and a bottom surface 519 and define a filter chambers 520. The filter slots 514 of the side walls 516 can be angled towards the bottom surface 519. The side walls 516 may be positioned generally perpendicular to the rear wall 518 to define generally rectangular shaped filter chambers 520. In some aspects, the side walls 516 may be positioned at other angles relative to the rear wall 518. In some aspects, the inclined blades 512 can be curved. The side walls 516 and rear wall 518 can include filter slots 514. The bottom surface 519 can be a solid material without filter slots 514. In some aspects, the bottom surface 519 may include perforations or filter slots 514.

An open end of the filter chambers 520 can be positioned downhole, as shown in FIG. 6A. In some aspects, the open end can be positioned uphole. The particle laden fluid accumulated by the particle accumulator 401 can exit the particle accumulator 401 and enter the open ends of the filter chambers 520 of the slotted filter 502. The fluid and smaller particles can flow through the filter slots 514 of the side walls 516 and rear wall 518. The particles in the particle laden fluid that are larger than the width of the filter slots 514 of the slotted filter 502 get stopped by the filter slots 514 of the side walls 516 and rear wall 518.

Some fluid can pass through the side walls 516 of the filter chambers 520. Some fluid can pass through the rear wall 518 of the slotted filter 502. Some fluid can travel along the length of the side walls 516 of the slotted filter 502 towards the rear wall 518. The particles stopped at the side walls 516 of the slotted filter 502 can be forced towards the rear wall 518 of the slotted filter 502 by the fluid flowing along the length of the side walls 516. The particles can collect where the rear wall 518 and the side walls 516 intersect. The region of the side walls 516 proximate to the open end of the slotted filter 502 can remain unclogged by particles. The fluid can continue to flow through the filter slots 514 of the side walls 516. The fluid can also continue to flow through the filter slots 514 of the rear wall 518 that is not proximate to where the rear wall 518 and side walls 516 intersect. The slotted filter 502 can filter particles from the fluid for a longer period of time by collecting the particles proximate to the region where the side walls 516 intersect the rear wall 518. The region of the filter slots 514 of the rear wall 518 that are not proximate to the side walls 516 can remain unclogged. In addition, fluid may flow between filter chambers 520 through the filter slots 514 of the side walls 516. Fluid may flow through the filter slots 514 of the side walls 516 of a filter chamber 520 that is full of debris to a different filter chamber 520 that may not be full of debris.

Example #1

An apparatus may comprise a first curved blade for use in a centrifuge for collecting debris particles in a fluid flowing through the centrifuge. The curved blade may further comprise a plurality of eccentric slots and a groove. The groove may be positioned at an outer edge of the curved blade. The curved blade may also include a first mating element and a second mating element. The first and second mating elements may be for coupling the first curved blade to a second curved blade about a central axis.

Example #2

The apparatus of Example #1 may further feature the second curved blade including a plurality of eccentric slots and a groove positioned at an outer edge of the second curved blade.

Example #3

The apparatus of Example #2 may further feature the first curved blade being further coupleable to a third curved blade and a fourth curved blade about the central axis to form the centrifuge.

Example #4

Any of the apparatuses of Examples #1-3 may further comprise a protrusion on one surface of the first curved blade. The apparatus may also further comprise a recess on a second surface of the curved blade for coupling the first curved blade on an additional curved blade. The first curved blade may be coupled to the additional curved blade in a linear direction.

Example #5

The apparatus of any of Examples #1-4 may feature a slot of the plurality of eccentric slots that intersects with the groove.

Example #6

Any of the apparatuses of Example #4 may feature a slot of the plurality of eccentric slots of the first curved blade that intersects with an eccentric slot of the additional curved blade.

Example #7

An assembly may comprise a diverter that extends inwardly from a casing string. The diverter may extend along a length of the casing string. The assembly may also include a cavity defined by the diverter and the casing string. The cavity may be for receiving debris particles accumulated by a centrifuge positioned proximate to the diverter. The assembly may include a valve extending between an inner surface of the casing string and an outer surface of the casing string. The valve may be in fluid communication with the cavity.

Example #8

The assembly of Example #7 may feature the diverter being positionable proximate to an end of the centrifuge. The centrifuge may include a plurality of blades. Each of the plurality of blades may have non-intersecting slots for filtering the debris particles from a fluid flowing through the centrifuge. The centrifuge may also include a groove on an outer edge of each of the plurality of blades. The groove may be for accumulating the debris particles filtered from the fluid flowing through the centrifuge.

Example #9

Any of the assemblies of Examples #7-8 may feature the valve being a one-way valve for ejecting the debris particles from the cavity into an annulus between the casing string and a wellbore in response to a pressure in the cavity exceeding a pre-set maximum.

Example #10

Any of the assemblies of Examples #7-9 may feature the cavity having a maximum width that is in a range of approximately 5% to approximately 15% of an inner diameter of the casing string.

Example #11

Any of the assemblies of Examples #7-10 may feature the centrifuge having a length in a range of approximately 1 foot to approximately 6 feet.

Example #12

Any of the assemblies of Examples #7-11 may feature the centrifuge being comprised of a drillable material.

Example #13

The assembly of Example #8 may feature the non-intersecting slots having a width in a range of approximately 0.1 mm to approximately 0.5 mm.

Example #14

An assembly may comprise a slotted filter that is generally circular in shape and positionable within a casing string. The slotted filter may include multiple filter chambers. Each of the multiple filter chambers may include a rear wall, side walls that intersect the rear wall, slots in the rear wall and the side walls, a bottom surface, and an open end. The open end may be positionable proximate to a centrifuge in the casing string for receiving a fluid containing debris particles collected by the centrifuge.

Example #15

The assembly of Example #14 may feature the bottom surface being a solid surface without any slots.

Example #15

Any of the assemblies of Examples #14-15 may feature the slots having a width in a range of approximately 0.1 mm to approximately 0.5 mm.

Example #17

Any of the assemblies of Examples #14-16 may feature the slotted filter comprising a drillable material.

Example #18

Any of the assemblies of Examples #14-17 may feature the centrifuge including a plurality of blades. Each blade of the plurality of blades may have non-intersecting slots for filtering the debris particles from a fluid flowing through the centrifuge. The centrifuge may also include a groove on an outer edge of each blade of the plurality of blades for collecting the debris particles filtered from the fluid flowing through the centrifuge.

Example #19

Any of the assemblies of Examples #14-18 may feature the slots of the side walls being angled towards the bottom surface for directing debris particles towards the bottom surface of the filter chamber.

Example #20

Any of the assemblies of Examples #14-19 may feature the slotted filter having a width that can be in a range of approximate 5% to approximately 15% of an inner diameter of the casing string.

The following aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly comprising:

a diverter extending inwardly from a casing string and extending along a length of the casing string;

a cavity defined by the diverter and the casing string, the cavity for receiving debris particles accumulated by a centrifuge positioned proximate to the diverter; and a valve extending between an inner surface of the casing string and an outer surface of the casing string, the valve being in fluid communication with the cavity, wherein the diverter is positionable proximate to an end of the centrifuge, the centrifuge including:

a plurality of blades, each of the plurality of blades having non-intersecting slots for filtering the debris particles from a fluid flowing through the centrifuge; and a groove on an outer edge of each of the plurality of blades for accumulating the debris particles filtered from the fluid flowing through the centrifuge.

2. The assembly of claim 1, wherein the valve is a one-way valve for ejecting the debris particles from the cavity into an annulus between the casing string and a wellbore in response to a pressure in the cavity exceeding a pre-set maximum.

3. The assembly of claim 1, wherein the cavity has a maximum width that is in a range of approximately 5% to approximately 15% of an inner diameter of the casing string.

4. The assembly of claim 1, wherein the centrifuge has a length in a range of approximately 1 foot to approximately 6 feet.

5. The assembly of claim 1, wherein the centrifuge is comprised of a drillable material.

6. The assembly of claim 1, wherein the non-intersecting slots have a width in a range of approximately 0.1 mm to approximately 0.5 mm.

* * * * *